US011084161B2

(12) United States Patent
Everingham

(10) Patent No.: US 11,084,161 B2
(45) Date of Patent: Aug. 10, 2021

(54) ANTI-ROTATIONAL TELESCOPIC POLE

(71) Applicant: Richard John Everingham, Thornton-Cleveleys (GB)

(72) Inventor: Richard John Everingham, Thornton-Cleveleys (GB)

( * ) Notice: Subject to any disclaimer, the term of this patent is extended or adjusted under 35 U.S.C. 154(b) by 319 days.

(21) Appl. No.: 15/911,390

(22) Filed: Mar. 5, 2018

(65) Prior Publication Data

US 2019/0270193 A1 Sep. 5, 2019

(51) Int. Cl.

| | |
|---|---|
| ***B25G 1/04*** | (2006.01) |
| ***A47L 9/06*** | (2006.01) |
| ***B08B 1/00*** | (2006.01) |

(52) U.S. Cl.

CPC ..... *B25G 1/04* (2013.01); *A47L 9/0673* (2013.01); *B08B 1/00* (2013.01); *B08B 1/002* (2013.01)

(58) Field of Classification Search

CPC ..... F16L 27/12; B25G 1/04
USPC ..... 285/7, 298, 302; 15/144.4
See application file for complete search history.

(56) References Cited

U.S. PATENT DOCUMENTS 2,641,012 A * 6/1953 Storrs ..... B25G 1/04 285/298
5,657,986 A * 8/1997 Parsons ..... F41B 15/025 135/75
6,854,697 B2 * 2/2005 Akaike ..... F16M 11/32 248/161
6,908,249 B2 * 6/2005 Tomm ..... F16B 7/1418 403/109.1
7,244,070 B2 * 7/2007 Burnett ..... G03B 17/00 248/118
7,461,476 B1 * 12/2008 Davis ..... A01K 87/002 43/18.1 CT
7,959,191 B2 * 6/2011 Schouten ..... A47L 13/23 285/298
8,006,711 B2 * 8/2011 Pietrzak ..... A45B 9/00 135/65
8,025,455 B2 * 9/2011 Huang ..... F16B 7/1418 280/287
8,422,716 B2 * 4/2013 Wetzel ..... F16B 7/14 248/337
8,608,118 B2 * 12/2013 Lai ..... F16B 7/1454 248/74.1
8,757,669 B2 * 6/2014 Chou ..... F16L 19/065 285/298
8,776,810 B2 * 7/2014 Lah ..... A45B 9/00 135/75

(Continued)

*Primary Examiner* — David Bochna
(74) *Attorney, Agent, or Firm* — John L. Sotomayor

(57) ABSTRACT

A cleaning tool comprising an extendable pole of two or more telescoping tubular members of a non-circular cross-section and having locking-clamping devices with the same form of noncircular cross-section. The telescoping tubular members are connected together through a clamping device, wherein one open end of the clamping device comprises an internal surface matching an external surface of a thicker tubular member and the second end of the clamping device comprises an internal surface and further comprises a notch extending through the length of the second end of the clamping device, and a lever mechanism, wherein the second end of the clamping device is arranged for diameter reduction upon performing a clamping action with said lever. The free end of the thinnest tubular member comprises means for attaching a cleaning tool.

8 Claims, 4 Drawing Sheets

(56) References Cited

U.S. PATENT DOCUMENTS

| | | | | |
|---|---|---|---|---|
| 9,109,616 | B1 * | 8/2015 | Ballentine | F16B 7/1454 |
| 9,643,266 | B1 * | 5/2017 | Hooyman | B23D 51/01 |
| 9,651,073 | B2 * | 5/2017 | Bukovitz | F16B 7/1454 |
| 2004/0078925 | A1 * | 4/2004 | Evans | F16L 27/12 15/414 |
| 2007/0108756 | A1 * | 5/2007 | Laakso | A63C 11/221 280/823 |
| 2013/0292938 | A1 * | 11/2013 | Grivetti | F16L 27/12 285/298 |
| 2017/0251895 | A1 * | 9/2017 | Lutz | A47L 5/28 |

* cited by examiner

ANTI-ROTATIONAL TELESCOPIC POLE

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever.

CLAIM OF PRIORITY

This Non-Provisional application claims under 35 U.S.C. § 119, the benefit of priority to the International Application GB1621302.7, filed in Great Britain Dec. 6, 2016, and Titled "Anti Rotational Telescopic Pole" which is hereby incorporated by reference in its entirety.

BACKGROUND

This invention relates to anti-rotational telescopic poles and cleaning tools. More specifically it relates to a cleaning tool comprising an extendable pole of two or more telescoping tubular members of a non-circular cross-section.

Extendable telescopic poles are well-known and have been used in many fields, such as cleaning and gardening tools, mounts for cameras and detectors, fishing rods, marine applications, painting walls, etc. Telescoping poles usually have two or more concentrically disposed tubular sections that are axially movable with respect to each other. The telescopic pole has an advantage of being collapsible to a compact dimension for easy transport and storage.

Relative movement of the telescopic sections is inhibited with a locking device housed within one or more of the inner sections. The locking device typically comprises a pin that is biased to extend from an inner section through a hole in an adjacent outer section.

The prior art technical sources describe variety of telescoping poles, which are made by using variety of different non-circular cross-sections and provide anti-rotation properties. Also, a number of prior art solutions feature various ways of how to lock together the members of telescoping poles.

Telescopic poles exist in a variety of design features. For example, a US patent No. US2004100109 describes an extendable reacher having a plurality of extendable sections, including a center section. The center section includes a distal portion that inserts into an opening in the rear wall of the handle to retain the reacher in its retracted position. The extendable sections include outer and inner surfaces that engage to prevent relative rotation of the sections and the tip. The telescoping arm of this reacher can be configured in a non-cylindrical shape, i.e. having two sides flat and thus ensuring resistance to rotation of the pole members with respect to one another.

Another US patent application No. U.S. Pat. No. 4,653,142 describes a tool such as the cleaning tool, which has an extensible handle comprising two or more telescoping tubes of elliptical or other noncircular cross-section which, when their axes are aligned, may be freely telescoped relative to one another until a desired extension is reached, and may then be rotated out of alignment to bind the tubes together.

Another US patent application No. U.S. Pat. No. 4,793,646 describes an adjustable handle and arm assembly. By providing at least two elongated, telescopically engaged tube members which incorporate therein a spring biased, dual locking pin structure in combination with tube aligning and centralizing zones, the unique, adjustable handle and arm assembly is achieved, which is capable of being easily moved into a plurality of alternate positions and securely engaged in each position, with unwanted dislodgement or lateral wobbling or movement being greatly reduced. In the preferred embodiment, the elongated telescopically engaged tube members are constructed with cooperating enlarged diameter zones and reduced diameter zones to prevent the unwanted disengagement of the tube members. In addition, a plurality of alternate operative end units can be quickly and easily mounted to said elongated handle and arm assembly, with one of said end units comprising a unique mooring clasp and book hook construction.

Yet another US patent application No. U.S. Pat. No. 6,343,568 describes a non-telescoping pole with interengaging sections that are convex polygonal in cross-section such that the sections are axially slidable with respect to each other but not rotatable. When said pole has three sections, upper, intermediate and lower, the sidewalls of upper section are preferably made with an incurved portion forming a longitudinal groove and the sidewalls of the lower section are preferably made with an outcurved portion forming a spline such that a cavity is formed between the grooves and the intermediate section and between the spline and the intermediate section to reduce friction between the sections.

Another U.S. Pat. No. 5,515,574 describes a non-cylindrical telescoping handle. Non-cylindrically shaped tube members, such as ergonomically designed substantially triangular shaped tubes, are slidably engaged within one another which allow the tubes to move only in a linear relationship with respect to one another. By preventing the tubular members from rotating relative to one another, the telescoping handle can be moved and locked into a plurality of alternate positions of varying lengths. A spring-snap button is provided in the inner tubular member whereby the snap button protrudes through an aperture in the outer member when the two structures come into alignment. Furthermore, an elongated opening is provided at the end of the outer tubular member providing an emergency stop to prevent the tube members from completely separating.

Yet another US patent application No. U.S. Pat. No. 4,325,157 describes the extension handle for a tool such as a paint roller, paint pad or the like includes a first tubular member including an attachment device for attaching the paint roller or the like thereto. The extension handle further includes a second tubular member telescopically mounted within the first tubular member. The second tubular member includes a detent mechanism that engages one of several detent capturing devices on the first tubular member thereby defining a plurality of stops allowing adjustment of the relative position of the first and second tubular members to provide the extension feature of the handle. The handle further includes an alignment structure including a groove in one of the first and second tubular members and a tongue in the other of the first and second members that engage each other to align the first and second tubular members and the detent and detent capturing mechanism relative to each other.

Chinese patent No. CN201973024 describes a utility model, which provides an anti-twisting telescopic rod related to the telescopic rod. The utility model provides the anti-twisting telescopic rod, which has the advantages that the twisting can be thoroughly avoided, and the use is convenient. The anti-twisting telescopic rod comprises a sleeve rod, an insertion rod, a joint and a locking screw, wherein the sleeve rod is a tubular sleeve rod, the insertion rod is a tubular insertion rod, the joint is a tubular joint, the joint is sheathed on the insertion rod, the joint is provided with an annular embedding groove which axially extends from the end surface, a rotation stop tooth is arranged in the annular embedding groove, the upper end of the sleeve rod is embedded in the annular embedding groove of the joint, the pipe wall of the upper end of the sleeve rod is provided with a rotation stop notch, the rotation stop tooth is embedded in the rotation stop notch, a screw hole is arranged at the upper end of the sleeve rod, a screw hole is arranged on the joint, and the sleeve rod is tightly locked with the insertion rod through a locking screw. The anti-twisting telescopic rod has wide application, and is particularly suitable for being used as a support rod for a tent.

US patent application No. U.S. Pat. No. 6,213,672 describes a telescoping self-aligning tube having the inner tube dimensioned and configured to fit within the outer tube which is equipped with a guide slot for receiving a snap button, thereby preventing rotation of the inner tube relative to the outer tube. The guide slot allows the telescoping tube to self-align such that the user does not have to twist and maneuver the inner and outer tubes when changing the tube length in order to align a detent button with its detent hole. Embodiments include detent holes located both within and radially opposite with respect to the guide slot. A Foam insert may be located on both ends of the inner tube allow the telescoping tube to be buoyant. A special layer of rubberized or polymer coating protects the cleaned surface from abrasions due to contact with the telescoping tube.

Australian patent application No. AU2013237640 describes a detector with the telescopic carrier/guide rod at which a measuring probe is disposed at one end, wherein the carrier/guide rod features at least two tubes longitudinally movable inside one another, in which respectively two tubes disposed adjacently in radial direction form an outer tube and an inner tube, whereby the respective outer tube at its overlapping tube end facing the measuring probe features a clamping means for engaging the inner tube. In accordance with this invention, the clamping means is formed as a clamping device that features a profile clamp with a quick-locking device. The profile clamp comprises a holding ring with two half shell-shaped clamping ring segments that are interconnected flexibly on one side and on the opposite side they can be clamped together with a clamping lever. The holding ring features ring breakthroughs and the outer tube the corresponding tube breakthroughs for the accommodation of clamping pieces that are pressed against the inner tube when clamping the clamping ring segments together under pressure. Preferably the clamping ring segment is formed on the holding ring.

However, no prior art solutions describe a locking-clamping device of the non-circular cross-section, which is compatible with telescoping tubular members of the non-circular cross-section respectively.

Furthermore, the prior art solutions mentioned above have obvious disadvantages, e.g. the last mentioned Australian patent describes the quick-locking device, in which two tubes longitudinally movable inside one another are clamped together with the clamping lever and two ring segments, thus these tubes experience huge influence of mechanical pressure, mechanical friction and attrition between certain regions of the tubular members. In case the pressure is not distributed evenly around the perimeter of tubular member ends, such localized pressure might cause the tubular member to collapse upon higher mechanical loads or the overall rigidity of such telescoping pole is rather poor.

BRIEF DESCRIPTION OF THE DRAWINGS

Certain illustrative embodiments illustrating organization and method of operation, together with objects and advantages may be best understood by reference to the detailed description that follows taken in conjunction with the accompanying drawings in which.

DETAILED DESCRIPTION

Figure 1:
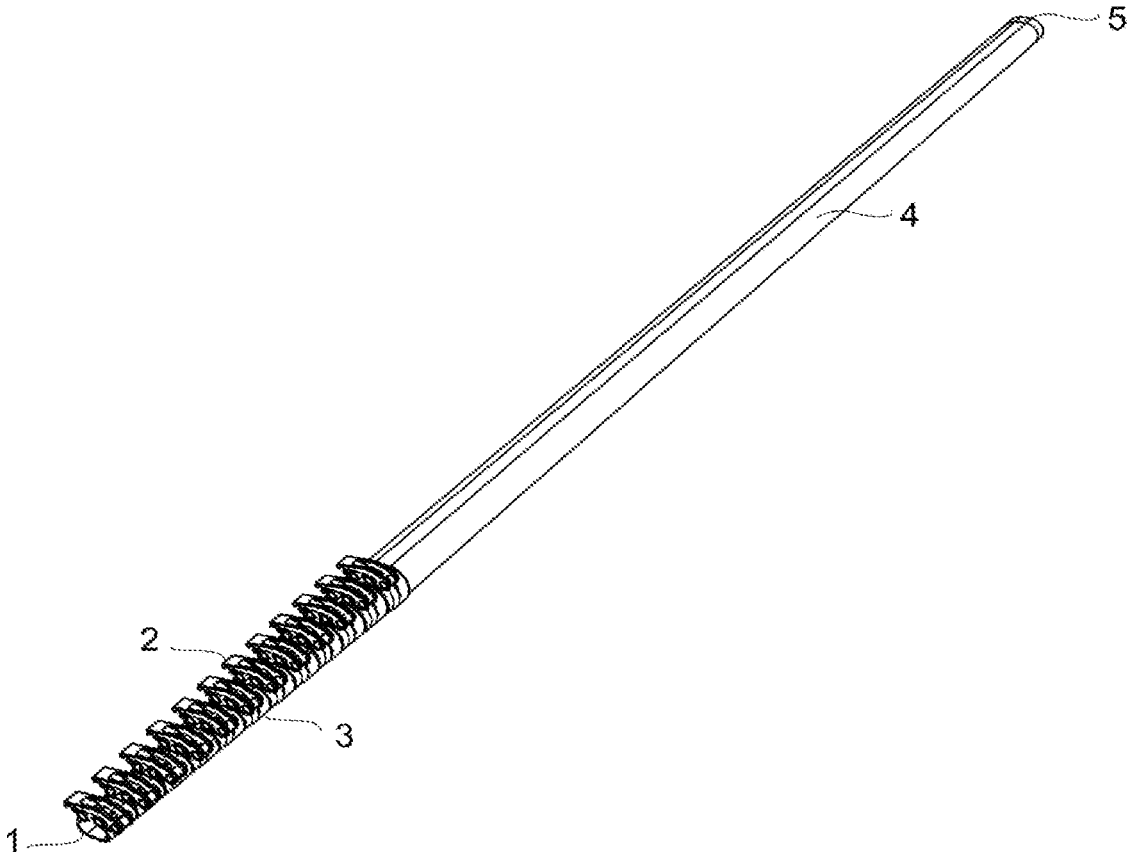
FIG. 1 is a view of an anti-rotational extendable telescopic pole, wherein telescoping tubular members of a noncircular cross-section, having two flat sides, have the locking clamping devices with the same form of non-circular cross-section and a clamping lever, which clamps the tubular members together consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

In order to reduce the disadvantages indicated above, this invention aims to create a cleaning tool comprising an extendable pole of two or more telescoping tubular members of a non-circular cross-section, which has two flat sides, and the clamping devices with the same form of non-circular cross-section, thus they serve as a locking mechanism for clamping together telescoping tubular members with a clamping lever.

The invention comprises a cleaning tool, which is mounted at one end of the telescoping pole that has telescopic tubular members, clamping devices with levers and the end cap that is attached to the other end of the telescopic pole. Telescoping tubular members of the pole are connected through the clamping device, wherein one open end of the clamping device comprises an internal surface matching an external surface of a thicker tubular member and the second end of the clamping device comprises an internal surface, which matches an external surface of a thinner tubular member. Also clamping device comprises a notch extending through the length of the second end of the clamping device, and a lever mechanism, wherein the second end of the clamping device is arranged for diameter reduction upon performing a clamping action with the lever.

One of the applications of the telescopic pole as the cleaning tool is realized, wherein the telescopic pole is converted into a waterfed pole by running a tube to the top of the pole, to which a brush tool is added. Another possible usage of this cleaning tool is a modular design of telescopic pole, wherein each tubular member is pieced together without the use of a clamp, thus creating an air tight connection, wherein the pole is arranged to be used in conjunction with vacuum equipment to either collect dust at height or to suck out dirt from guttering.

In an embodiment, the cleaning tool is mounted on the top of anti-rotational telescopic pole for the application of the cleaning industry. The free ends of the thinnest tubular member and the thickest tubular member have no clamping devices attached and the free end of the thinnest tubular member comprises means for attaching a cleaning tool. There are various means for attaching the cleaning tool to the anti-rotational telescopic pole, for example various mounts, articulated or swivel joints of different shapes and configurations.

In a non-limiting example, a brush tool is mounted on the free end of the thinnest tubular member. Additional means for water delivery can be used to convert the anti-rotational telescopic pole into a waterfed pole. For example, a water-tight telescoping pole itself or a hose attached externally along the extended pole carries a liquid solution to the brush head tool utilizing a water pump delivery device of which they are many. Its purpose is to soften the dirt on the surface to be cleaned and additionally rinse away the mixture of dirt and liquid agitated in conjunction with the brush tool. It can also be used in conjunction with a higher pressured water nozzle and lance, which will softly spray liquid onto a larger surface. A bit like a pressure washer but with less water pressure.

In an alternative embodiment, the anti-rotational telescopic pole is modular, wherein each telescopic tubular member is pieced together with use of the locking-clamping devices, thus creating an air-tight connection between the telescoping members. In this embodiment the pole is arranged to be used in conjunction with vacuum equipment to either collect dust at height or to suck out dirt from guttering. To create an air-tight modulus pole the tolerance between each pole section is virtually 0 mm or additional gaskets shall be used. The base of the first pole is slightly "coned" in shape allowing the top of the proceeding section to insert. When inserted fully and no gap is noticed, thus air tight connection is realized. Another way is to have a minimal tolerance allowing the telescopic pole section to be clamped and uses a slightly modified larger version of non-circular clamp device and squeezing the pole sections together and thus forming an air tight connection.

In an embodiment, the first open end of the clamping device is permanently attached to the external surface of the thicker tubular member by gluing, thermal forming, molding or similar. A person skilled-in-the-art might use other methods of attachment, if it ensures air-tight connection between the outer surface of the tubular member and the inner surface of the first open end of the clamping device.

In the embodiment where the telescoping pole has an air-tight connection between the telescoping members, the complete body of the clamping device or just the second end thereof can be made of an elastic material, which molds onto the surface of the thinner tubular member in an air-tight fashion, but allows relative translation of the thinner tubular member in a telescoping action.

Similarly, the notch of the clamp body can be filled with an elastic material, such as rubber. Such filling ensures air tightness, whereas the complete stiff body of the clamping device and the clamp itself in its locked position ensure high rigidity of the entire pole in its extended position.

Yet in another embodiment, the present invention can be used in many fields, where stable, long-term and strong anti-rotational telescopic poles are needed because the external surfaces of thicker tubular members with clamping devices mounted thereto, suffer much less mechanical pressure than the external surfaces of a thinner tubular members that are clamped with clamping levers, thus this locking device decreases influence of mechanical pressure, mechanical friction and attrition between parts, as compared to other mechanisms used for the clamping of tubes.

Turning now to FIG. 1, this figure presents a view of a view of an anti-rotational extendable telescopic pole, wherein telescoping tubular members of a noncircular cross-section, having two flat sides, have the locking clamping devices with the same form of non-circular cross-section and a clamping lever, which clamps the tubular members together consistent with certain embodiments of the present invention. In an exemplary embodiment, the innovation comprises an anti-rotational telescopic pole with non-circular cross-sections (1) and locking-clamping devices (2) with the same shape of cross-sections respectively.

In one or more non-limiting examples, the invention may be used to form a handle for cleaning or gardening tools, mounts for cameras and detectors, fishing rods, marine applications, painting walls, etc.

The present invention comprises the telescoping pole, which has two or more telescoping tubular members (3) of the non-circular cross-section (1), which have two flat sides to ensure resistance to rotation of extendable members (3) with respect to each other. Said telescoping tubular members (3) are extractable from one end of a main tube (4), which is used for holding and handling the entire pole, while the other end of the main tube (4) has an end cap (5) attached thereto. Telescoping tubular members (3) of the extendable pole are connected through locking-clamping devices (2) which comprise clamp bodies (6) with the same non-circular cross-sections, having two flat sides to ensure anti-rotational locking of non-circular tubular members (3). One open end of the clamping device (2) comprises an internal surface matching an external surface of a thicker tubular member and the second end of the clamping device comprises an internal surface, which matches an external surface of a thinner tubular member, preferably with small dimensional tolerances.

The present invention features safer handling, when holding the anti-rotational telescopic pole with locking-clamping devices (2) of the same non-circular cross-section. Two flat sides of said cross-sections provide additional safer grip and control, as compared to other cases, wherein a round shaped pole is used.

Figure 2:
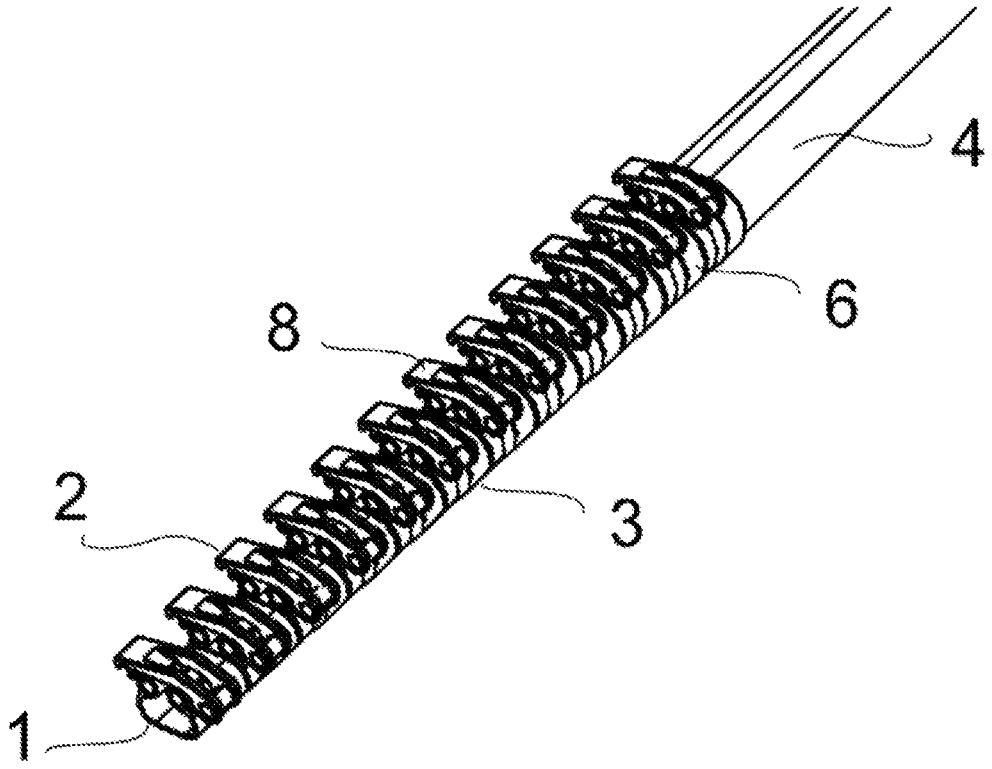
FIG. 2 is a view of an anti-rotational extendable telescopic pole, wherein telescoping tubular members have a noncircular cross-section consistent with certain embodiments of the present invention.

Turning now to FIG. 2, this figure presents a view of an anti-rotational extendable telescopic pole, wherein telescoping tubular members have a noncircular cross-section consistent with certain embodiments of the present invention. In an exemplary embodiment, the system presents a clamp body (6) that comprises a notch (see FIG. 3, item 7) extending through the length of the second end of the clamping device (2), and a lever (8) mechanism, wherein the second end of the clamping device (2) is arranged for diameter reduction upon performing a clamping action with the lever (8). The locking-clamping device (2) comprises one pin (9), which is inserted into the clamping lever through two holes of the clamping lever (8).

Figure 3:
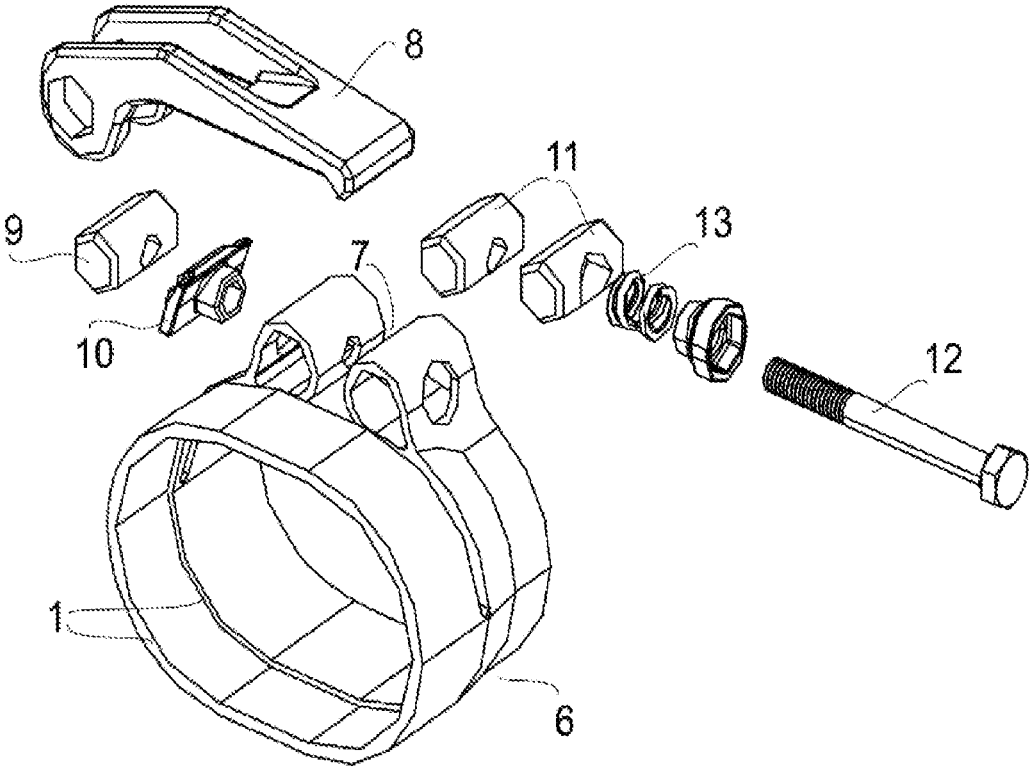
FIG. 3 is a view of a locking-clamping device with the non-circular cross-sections and a clamping lever, which can clamp together telescopic tubular members consistent with certain embodiments of the present invention.

Turning now to FIG. 3, this figure presents a view of a locking clamping device with the non-circular cross-sections and a clamping lever, which can clamp together telescopic tubular members consistent with certain embodiments of the present invention. In an exemplary embodiment, the clamping lever (8) with the pin (9) are assembled onto a lever holder (10), which is placed on the top of the clamp body (6) so that circular holes of the lever holder (10) and the clamp body (6) match together essentially concentrically. Then two hollow pins (11) are inserted into the clamp body (6) so that their circular holes are near by the circular holes of clamp body (6). A screw (12) and a spring (13) are inserted into clamp body (6) through circular holes of clamp body (6), two hollow pins (11), the lever holder (10) and the pin (9) for holding the components of the locking mechanism together.

Figure 4:
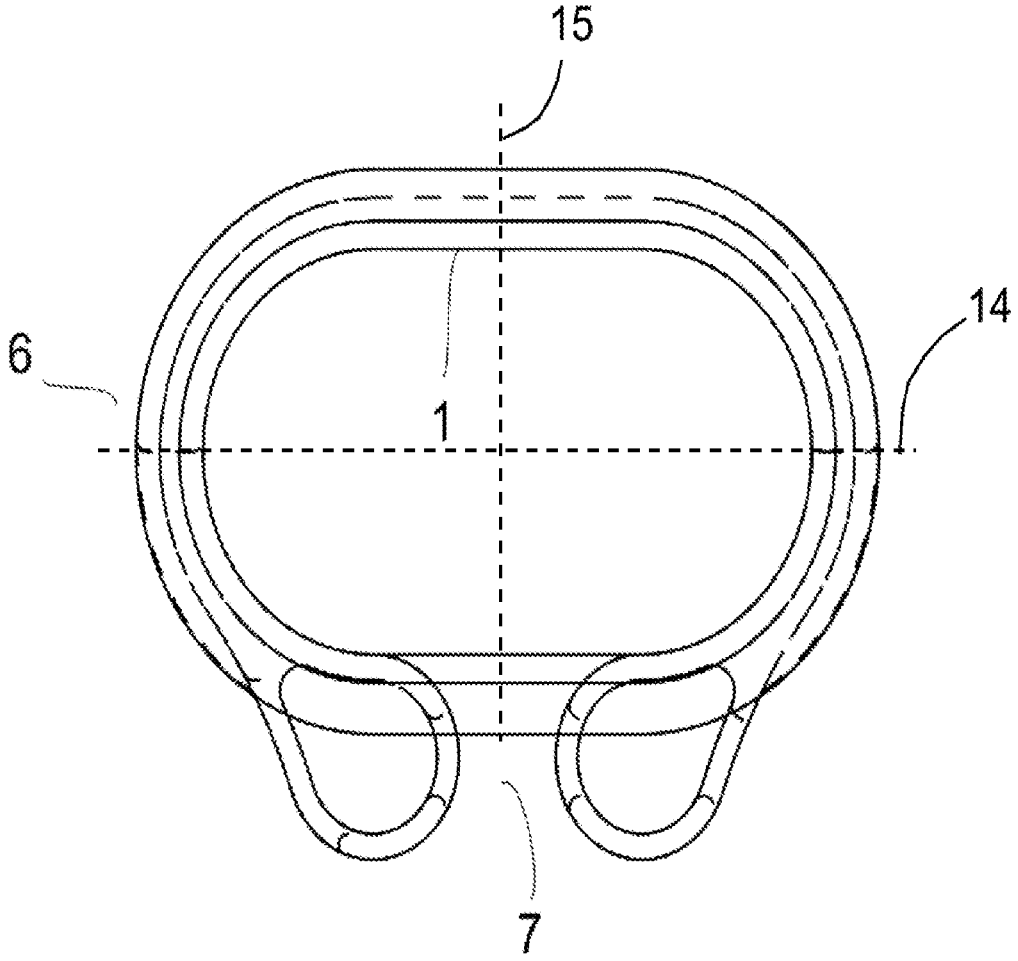
FIG. 4 is a view of a schematic drawing of cross-sections of a clamp body of a clamping device consistent with certain embodiments of the present invention.

Turning now to FIG. 4, this figure presents a schematic drawing of cross-sections of a clamp body of a clamping device consistent with certain embodiments of the present invention. In an exemplary embodiment, the two flat sides of said non-circular cross-section have substantially the same length and are substantially parallel, and the cross-section diameter along the axis parallel to two flat sides is substantially longer than the cross-section diameter perpendicular to the two flat sides. The skilled person will recognize this shape as a stadium or flattened oval, comprising two substantially parallel flat sides and two approximately circular sections. The cross-sections of the telescopic poles (1) and the clamp bodies (6) have substantially the same form and shape.

The flat sides are substantially the same length, which may make assembly of the telescopic pole easier.

The non-circular cross-section has a first (14) and second (15) diameter:

- a first (or 1st) diameter (14), extending through the centre of symmetry of the cross-section, and further extending substantially parallel to the two flat sides. The first diameter (14) is pictured horizontally in FIG. 4.
- a second (or 2nd) diameter (15), extending through the center of symmetry of the cross-section, and further extending substantially perpendicular to the two flat sides. The first (14) and second (15) diameters are approximately perpendicular to each other. The second diameter (15) is pictured vertically in FIG. 4.

When seen in cross-section, the length of each flat side is preferably 10-60% of the first diameter (14), more preferably 35 to 57%, and most preferably approximately 50% of said first diameter (14).

This is calculated in percentage by dividing the outer length of the flat by the first outer diameter (14), or by dividing the inner length of the flat by the first inner diameter (14).

When seen in cross-section, first diameter (14) is substantially longer than the second diameter (15) as it is a flattened oval or stadium shape. Preferably the second diameter (15) is 45-91% of the first diameter (14), more preferably 80 to 91%.

This is calculated as a percentage by dividing the second outer diameter (15) by the first outer diameter (14), or by dividing the second inner diameter (15) by the first inner diameter (14).

Example 1: an extendable telescopic pole may be assembled using thirteen tubular members (3) having the following cross-sectional dimensions in mm:

| Tubular member | Outer 1st diameter (14) | Outer 2nd diameter (15) | Inner 1st diameter (14) | Inner 2nd diameter (15) | Outer flat length |
|---|---|---|---|---|---|
| a | 36.00 | 18.00 | 34.00 | 16.00 | 19.75 |
| b | 38.20 | 20.20 | 36.20 | 18.20 | 20.00 |
| c | 40.40 | 22.40 | 38.40 | 20.40 | 20.75 |
| d | 42.60 | 24.60 | 40.60 | 22.60 | 20.75 |
| e | 44.80 | 26.80 | 42.80 | 24.80 | 22.00 |
| f | 47.00 | 29.00 | 45.00 | 27.00 | 22.25 |
| g | 49.20 | 31.20 | 47.20 | 29.20 | 22.50 |
| h | 51.40 | 33.40 | 49.40 | 31.40 | 23.00 |
| i | 53.60 | 35.60 | 51.60 | 33.60 | 23.00 |
| j | 55.80 | 37.80 | 53.80 | 35.80 | 23.00 |
| k | 58.00 | 40.00 | 56.00 | 38.00 | 23.00 |
| l | 60.20 | 42.20 | 58.20 | 40.20 | 23.00 |
| m | 62.40 | 44.40 | 60.40 | 42.40 | 23.00 |

All dimensions may have a tolerance of +/−0.01 mm. Tubular member m is also described herein as the main tube (4) or thickest tubular member (3). Tubular member a is also described herein as the thinnest tubular member (3).

The tubular members in this example have tube walls of 1 mm+/−0.01 mm. A clearance of 0.10 mm+/−0.01 mm is provided between the outer diameter of an inner tubular member and the inner diameter of an outer member—that is, between concentric tubular members (3)—to allow a suitable degree of axial movement between an inner and an outer tubular member (3).

In a non-limiting example, an extendable telescopic pole may be further assembled using device clamps (2) having substantially the same form of non-circular cross-section as tube members, and the following cross-sectional inner dimensions in mm:

| Clamp device | | First end inner 1st diameter (14) | First end inner 2nd diameter (15) | Second end inner 1st diameter (14) | Second end inner 2nd diameter (15) |
|---|---|---|---|---|---|
| c1 | (tool to a) | 36.00 | 18.00 | 33.80 | 15.80 |
| c2 | (a to b) | 38.20 | 20.20 | 36.00 | 18.00 |
| c3 | (b to c) | 40.40 | 22.40 | 38.20 | 20.20 |
| c4 | (c to d) | 42.60 | 24.60 | 40.40 | 22.40 |
| c5 | (d to e) | 44.80 | 26.80 | 42.60 | 24.60 |
| c6 | (e to f) | 47.00 | 29.00 | 44.80 | 26.80 |
| c7 | (f to g) | 49.20 | 31.20 | 47.00 | 29.00 |
| c8 | (g to h) | 51.40 | 33.40 | 49.20 | 31.20 |
| c9 | (h to i) | 53.60 | 35.60 | 51.40 | 33.40 |
| c10 | (i to j) | 55.80 | 37.80 | 53.60 | 35.60 |
| c11 | (j to k) | 58.00 | 40.00 | 55.80 | 37.80 |
| c12 | (k to l) | 60.20 | 42.20 | 58.00 | 40.00 |
| c13 | (l to m) | 62.40 | 44.40 | 60.20 | 42.20 |

All dimensions may have a tolerance of +/−0.01 mm. The clamping devices (2) in this example have tube walls of 2 mm+/−0.01 mm.

Clamp devices c2 to c13 may be used to assemble and clamp this example of extendable telescopic pole using tubular members a to m. Each clamp device is configured to clamp an outer and inner tubular member concentric pair.

The inner diameter of each first end is dimensioned to have an internal diameter substantially equal to the outer diameter of the outer tubular member to be attached that clamp device.

Each second end is provided with a notch extending through the axial length of the second end of the clamping device, arranged to allow the diameter of the second end to be reduced. The second end of the clamping device is clamped using the lever mechanism to the relevant inner tubular member.

The inner diameter of each second end is dimensioned to have an internal diameter substantially equal to the outer diameter of the relevant inner tubular member to be clamped. This provides a satisfactory amount of resistance when the lever mechanism is unclamped, such that the inner tubular member can still be resistively moved to provide the required telescopic extent.

Clamp device c1 may be used to clamp a brush or cleaning tool with similar tolerances to said tubular member, for example having an outer 1st diameter (14) of 33.80 mm+/−0.01 mm and an outer 2nd diameter (15) of 15.80 mm+/−0.01 mm.

Example 2: an extendable telescopic pole may be assembled using nine tubular members (3) having the following cross-sectional dimensions in mm:

| Tubular member | Outer 1st diameter (14) | Outer 2nd diameter (15) | Inner 1st diameter (14) | Inner 2nd diameter (15) | Outer flat length |
|---|---|---|---|---|---|
| n | 22.75 | 18.50 | 20.25 | 16.00 | 12.50 |
| o | 25.75 | 21.50 | 23.25 | 19.00 | 13.25 |
| p | 28.75 | 24.50 | 26.25 | 22.00 | 14.00 |
| q | 31.75 | 27.50 | 29.25 | 25.00 | 14.75 |
| r | 34.75 | 30.50 | 32.25 | 28.00 | 15.50 |
| s | 37.75 | 33.50 | 35.25 | 31.00 | 16.25 |
| t | 40.75 | 36.50 | 38.25 | 34.00 | 17.00 |
| u | 43.75 | 39.50 | 41.25 | 37.00 | 17.75 |
| v | 46.75 | 42.50 | 44.25 | 40.00 | 18.50 |

All dimensions may have a tolerance of +/−0.01 mm. Tubular member v is also described herein as the main tube (4) or thickest tubular member (3). Tubular member n is also described herein as the thinnest tubular member (3).

The tubular members in this example have tube walls of 1.25 mm+/−0.01 mm. A clearance of 0.25 mm+/−0.01 mm is provided between the outer diameter of an inner tubular member and the inner diameter of an outer member—that is, between concentric tubular members (3)—to allow a suitable degree of axial movement between an inner and an outer tubular member (3).

In an alternate non-limiting example, the extendable telescopic pole may be further assembled using device clamps (2) having substantially the same shape of non-circular cross-section as tube members, and the following cross-sectional inner dimensions in mm:

| Clamp device | | First end inner 1st diameter (14) | First end inner 2nd diameter (15) | Second end inner 1st diameter (14) | Second end inner 2nd diameter (15) |
|---|---|---|---|---|---|
| c14 | (tool to n) | 22.75 | 18.50 | 19.75 | 15.50 |
| c15 | (n to o) | 25.75 | 21.50 | 22.75 | 18.50 |
| c16 | (o to p) | 28.75 | 24.50 | 25.75 | 21.50 |
| c17 | (p to q) | 31.75 | 27.50 | 28.75 | 24.50 |

-continued

| Clamp device | | First end inner 1st diameter (14) | First end inner 2nd diameter (15) | Second end inner 1st diameter (14) | Second end inner 2nd diameter (15) |
|---|---|---|---|---|---|
| c18 | (q to r) | 34.75 | 30.50 | 31.75 | 27.50 |
| c19 | (r to s) | 37.75 | 33.50 | 34.75 | 30.50 |
| c20 | (s to t) | 40.75 | 36.50 | 37.75 | 33.50 |
| c21 | (t to u) | 43.75 | 39.50 | 40.75 | 36.50 |
| c22 | (u to v) | 46.75 | 42.50 | 43.75 | 39.50 |

All dimensions may have a tolerance of +/−0.01 mm. The clamping device ends (2) in this example have tube walls of 3 mm+/−0.01 mm.

Clamp devices c15 to c22 may be used to assemble and clamp this example of extendable telescopic pole using tubular members n to v. Each clamp device is configured to clamp an outer and inner tubular member concentric pair in the same way as described for example 1.

Clamp device c14 may be used to clamp a brush or cleaning tool with similar tolerances to tubular member a, for example having an outer 1st diameter (14) of 17.75 mm+/−0.01 mm and an outer 2nd diameter (15) of 13.50 mm+/−0.01 mm.

The dimensions given are purely exemplary and to illustrate the principles of composition. The skilled person will realize that starting with these examples, a wide variety of extendable telescopic poles may be provided. The dimensions and tolerances used depend, for example, on the requirements of the user, operating length, maximum acceptable weight, and the materials used. The tubular members (1) and clamping device ends (2) may be made of, for example, carbon fiber, metal, plastic or any combination thereof. Material such as carbon fiber for the tubular members and nylon for the clamping device ends may be particularly advantageous for use in manufacturing the disclosed device components.

While certain illustrative embodiments have been described, it is evident that many alternatives, modifications, permutations and variations will become apparent to those skilled in the art in light of the foregoing description.

I claim:

1. An extendable telescopic pole comprising:

an inner tubular member and an outer tubular member of a non-circular cross-section, each tubular member having two flat sides disposed between two curved sections to ensure resistance to rotation of the tubular members with respect to each other, the tubular members being concentrically disposed and axially movable with respect to each other for telescoping, the inner tubular member being thinner than the outer tubular member;

a clamping device for inhibiting movement between the inner and outer tubular members;

the tubular members being connected together through the clamping device;

the clamping device comprising:

a first open end having a first internal surface of the same non-circular cross-section matching an external surface of the outer tubular member, the first internal surface being attached to said external surface of the outer tubular member;

a second end having a second internal surface of the same non-circular cross-section, which matches an external surface of the inner tubular member;

a notch extending through the axial length of the second end of the clamping device, arranged to allow the diameter of the second end to be reduced;

a lever mechanism, disposed in a perpendicular orientation to said notch and physically connected in parallel to a screw passing through a clamp body having said screw and a spring inserted into the clamp body, said screw arranged to draw together two portions of said clamp body when said lever mechanism is pulled closer to said clamp body in a clamped position; and said clamp body further comprising two half shell-shaped clamping ring segments that are flexibly interconnected and arranged to reduce the diameter of the second end upon performing a clamping action with said lever mechanism to grip only the side walls of said tubular members when said lever mechanism in placed in the clamped position, whereby the inner and outer tubular members are clamped together.

2. The extendable telescopic pole according to claim 1, comprising more than two concentrically disposed telescoping tubular members of said non-circular cross-section.

3. The extendable telescopic pole according to claim 2, wherein the non-circular cross-section is oval or stadium shape with two substantially parallel flat sides.

4. The extendable telescopic pole according to claim 1, wherein free ends of the thinnest tubular member and the thickest tubular member have no clamping devices attached, and the free end of the thinnest tubular member comprises means for attaching a cleaning tool.

5. The extendable telescopic pole according to claim 1, wherein the free end of the thinnest tubular member has no clamping devices attached, and comprises means for attaching a brush tool.

6. The extendable telescopic pole according to claim 5, wherein the first internal surface is permanently attached to said external surface of the outer tubular member.

7. The extendable telescopic pole according to claim 1, wherein the extendable telescopic pole is modular, wherein each tubular member is pieced together by creating an air tight connection, wherein the pole is arranged to be used in conjunction with vacuum equipment to either collect dust at height or to suck out dirt from guttering.

8. The extendable telescopic pole according to claim 7, wherein the tubular members have minimal dimensional tolerances allowing the tubular members to be clamped using the clamp device and squeezing the tubular members together and thus forming the air tight connection.

* * * * *